US006499412B2

(12) United States Patent
Cochran et al.

(10) Patent No.: US 6,499,412 B2
(45) Date of Patent: Dec. 31, 2002

(54) METHOD OF FIREBOX TEMPERATURE CONTROL FOR ACHIEVING CARBON MONOXIDE EMISSION COMPLIANCE IN INDUSTRIAL FURNACES WITH MINIMAL ENERGY CONSUMPTION

(75) Inventors: Mayra Rodriguez Cochran, Houston, TX (US); Charles Anthony Dafft, Friendswood, TX (US); Michael Stanley DeCourcy, Houston, TX (US); James Edward Elder, Houston, TX (US); John Edward Henderson, League City, TX (US); Frederick Paul Fendt, Cherry Hill, NJ (US)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/940,318

(22) Filed: Aug. 28, 2001

(65) Prior Publication Data

US 2002/0033125 A1 Mar. 21, 2002

Related U.S. Application Data

(60) Provisional application No. 60/233,205, filed on Sep. 15, 2000.

(51) Int. Cl.[7] ..... F23B 7/00; F23N 5/18; F23N 5/22

(52) U.S. Cl. ..... 110/346; 110/341; 110/185; 110/186; 110/191; 110/101 C; 110/101 CF

(58) Field of Search ..... 110/185, 186, 110/187, 188, 189, 190, 191, 341, 346, 238, 235, 101 C, 101 CF, 101 CA; 431/76, 89

(56) References Cited

U.S. PATENT DOCUMENTS 4,260,363 A * 4/1981 Cratin ..... 431/76
4,360,336 A * 11/1982 Shepherd ..... 431/12
4,638,789 A * 1/1987 Ueki et al. ..... 126/351
4,645,450 A * 2/1987 West ..... 431/12
5,280,756 A * 1/1994 Labbe ..... 110/191
5,401,162 A * 3/1995 Bonne ..... 431/12
5,609,104 A * 3/1997 Yap ..... 110/235
5,660,542 A * 8/1997 Rinker et al. ..... 432/219
5,832,842 A * 11/1998 Frontini et al. ..... 110/190
6,189,460 B1 * 2/2001 Abe et al. ..... 110/185
6,213,758 B1 * 4/2001 Tesar et al. ..... 431/12

OTHER PUBLICATIONS

Shinskey, F.G., "Process Control Systems—Application, Design, and Adjustment", McGraw–Hill Book Company, New York (1988), pp. 348–353.

Sellers, L., "Improving Equipment Operations" Industrial Energy Technology Conference, Houston, May, 1999, pp. 6–11.

Freeman, H.M., Ed., "Standard Handbook of Hazardous Waste Treatment and Disposal", McGraw–Hill Book Company, New York (1989), pp. 8.18–8.21, 8.44–8.47, 8.52–8.53, 8.226–8.227, 8.238–8.241 and 8.246–8.249.

Wunderle, J.A., et al., "Combustion Efficiency Optimization Manual for Operators of Oil– and Gas–Fired Boilers", U.S. Environmental Protection Agency, Sep. 1983, pp. 1–39.

* cited by examiner

*Primary Examiner*—Ira S. Lazarus
*Assistant Examiner*—K. B. Rinehart
(74) *Attorney, Agent, or Firm*—Alan Holler

(57) ABSTRACT

The present invention provides a novel method of controlling the incineration temperature of industrial waste incineration processes such that the incineration emissions products comply with governmental regulations and operating and capital costs are minimal. Modifying the incineration temperature in response to changes in the emission products and the waste streams results in optimal and reliable control of the incineration process and the resultant incineration emissions. Capital and operating costs are reduced significantly as a result.

10 Claims, 5 Drawing Sheets

METHOD OF FIREBOX TEMPERATURE CONTROL FOR ACHIEVING CARBON MONOXIDE EMISSION COMPLIANCE IN INDUSTRIAL FURNACES WITH MINIMAL ENERGY CONSUMPTION

CROSS REFERENCE TO RELATED PATENT APPLICATIONS

This is a non-provisional application of prior pending U.S. provisional application Ser. No. 60/233,205 filed Sep. 15, 2000.

BACKGROUND

This invention relates to the field of industrial waste disposal, and more particularly, to the incineration of industrial waste streams in thermal oxidizers, furnaces, combustors, or incinerators (hereinafter individually and collectively referred to as "incinerators"), in combination with or without a boiler, in industrial processing industries such as the chemical industry (e.g., industrial process pertaining to the production of acrylonitrile, acrylic acid and its esters, methacrylic acid and its esters, and vinyl chloride monomers), petroleum refining industry, petrochemical industry, pharmaceutical industry, and the food industry.

Waste streams that are generally subject to incineration may be produced in industries such as the chemical industry, petroleum refining industry, petrochemical industry, pharmaceutical industry, and the food industry. Such waste streams may be sludges, slurries, gases, liquids, oils or combinations thereof For example, chemical processes that produce waste streams that need to be disposed of include the production of acrylonitrile, methacrylic acid and its esters, acrylic acid and its esters, vinyl chloride monomer, phenol, synthesis gas, and ethylene. Some petroleum refining sources of waste streams include: hydrotreater purge gas; catalytic reformer overhead gas; and fuel gas from the stabilizer column. Chemical plant sources include: waste hydrogen streams; vent header streams; slop-oil streams; absorber and stripper column overhead streams; and effluents from waste water treatment systems.

An incineration process is a rapid oxidation process that releases energy that may or may not be harnessed to do useful work such as producing steam in a boiler. Although incineration processes can achieve high destruction efficiencies, these systems are typically expensive to operate due to the energy involved. Most importantly, incineration systems have secondary emissions associated with their operation that are heavily regulated by environmental agencies such as the Environmental Protection Agency (the "EPA") and the Texas Natural Resources Conservation Commission (the "TNRCC"). Substances in incineration emissions that typically are regulated are: CO and $NO_x$. $CO_2$ is also a concern as it is a greenhouse gas. Generally, environmental regulations limit the amount of these substances that can be emitted from a company's waste incineration process on an hourly basis. Thus, the goal when disposing of waste streams through incineration is to comply with the applicable environmental regulations while minimizing energy consumption so that the process is cost-effective. Conventional incineration systems for industrial waste streams have failed to meet this goal.

In heretofore known incineration systems, environmental regulatory specifications limit the operating conditions of the incineration process to specific operating conditions used during a "stack test." Usually, the "stack test" is run in a worst case scenario. Therefore, the operating conditions such as temperature, fuel, and air that are dictated by the stack test are not sufficiently flexible to adjust to changes in the composition, feed rate or fuel value of the waste streams. Operating conditions based on this single "worst case" approach are seldom varied as they oftentimes are dictated by rigid environmental permit requirements. Further, there is little opportunity for change as stack tests are performed infrequently. While this approach assures emissions compliance, its inflexibility also guarantees that the incinerator is always run at its most costly operating conditions.

In conventional industrial waste incineration processes operated at stack test operating conditions, a waste stream is generally combined in a furnace with a large amount of fuel, such as natural gas, and an excess of air. Because a large amount of fuel is used, the emissions that are produced from this conventional process usually comply with environmental regulations. However, this method is not cost-effective because natural gas, the primary fuel, is expensive. Also, because an excess of fuel is used, the temperature of the incinerator is very high, usually from about 1000° F. (538° C.) to about 2000° F. (1076° C.). These high temperatures, in combination with the nitrogen in the air feed to the system, create an undesirable amount of $NO_x$, a heavily regulated emission substance.

Traditionally, efforts to minimize CO and $NO_x$ emissions from incineration systems have focused on the adjustment of air (e.g., temperature, flow, and distribution) in the system and optimization of its distribution. This has been done by monitoring the oxygen content of the emissions.

Measuring or monitoring the oxygen content of incineration emissions has been used in conventional systems as a standard feedback control, wherein adjustments to the air feed into the incineration system ultimately control the amount of CO in the incineration emissions. Insufficient air makes the system fuel-rich, which may pose an explosion hazard. While an excess of air avoids this problem and is favorable to achieving complete combustion, too much air results in excess $NO_x$ formation and requires greater energy consumption. Also, using more air means bigger fans, which in and of themselves are expensive. Heretofore known systems have not looked to temperature as the controlling variable to optimize the system; therefore, the conventional means to achieve optimization of the incineration process, i.e., by controlling the air feed through monitoring the oxygen content of the emissions, results in burdening the incineration process with excess air that must be heated and an excess formation of CO and $NO_x$ in the emissions. Operating costs are high and efficiency is low when control of the incineration process is solely limited to this method.

Another problem with some of the conventional incineration systems using the oxygen content of the emissions as a means to optimize the system is that, if the condition of the waste stream changes, the incineration system is unable to adapt to those changes optimally and reliably, resulting in inefficient and costly process performance and possibly regulatory noncompliance. Process parameters such as temperature in conventional systems are not adjusted to changes in the waste stream. Further, in conventional systems, the only means to address changes in the waste stream has historically been to add an excess of air to the system, which results in the disadvantages described above.

However, notwithstanding the awareness of these regulations, many of the conventional incineration methods have not been able to ensure their compliance on a cost-effective basis. Accordingly, the industrial processing industries would greatly welcome a method which not only controls emissions from industrial waste incineration processes such that compliance with environmental regulations is ensured, but also provides a method of incinerating waste wherein capital and operating costs are reduced significantly.

STATEMENT OF INVENTION

Therefore, one object of the present invention is to provide novel methods to optimize an industrial waste incineration process such that emissions from the process comply with environmental regulations and the process is cost-effective.

Another object of this invention is to provide novel methods which enable the incineration process to adapt quickly and accurately to changes in the waste stream (e.g., changes in its fuel value, temperature, feed rate, or composition), in a manner such that the emissions remain at or under the target level.

These and other objects that will become apparent to those skilled in the art upon reading this specification are based, in part, on the surprising discovery that modifying the operating temperature (hereinafter referred to as "the firebox temperature") of the incinerator, in response to changes in the emissions products and waste streams, results in the ability to consistently control the incineration process and the resultant incineration emissions.

The present invention pertains to novel methods for incinerating industrial waste. In one embodiment, a method encompasses by the present invention includes the steps of:

(a) determining whether a waste stream is being fed into the incinerator, (b) evaluating a CO emission rate to calculate the CO emissions rate minus a target CO rate (hereinafter "ΔCO"), and (c) adjusting a firebox temperature of an incinerator in response to the ΔCO calculation.

In another embodiment, a method encompassed by the present invention includes the steps of:

(a) determining whether a waste stream having a feed rate and a fuel content is being fed into an incinerator;

(b) measuring the feed rate of the waste stream to calculate a the mass flow rate of the waste stream at a time $t_1$, minus the mass flow rate of the waste stream at a time $t_0$, where $t>t_0$ (hereinafter "ΔM");

(c) adjusting a firebox temperature of the incinerator if ΔM is greater than or less than 0;

(d) analyzing the energy content of the waste stream to calculate the energy content of the waste stream at a time $t_1$, minus the energy content of the waste stream at a time $t_0$, where $t_1>t_0$ (hereinafter referred to as "ΔE");

(e) adjusting the firebox temperature of the incinerator if ΔE is greater than or less than 0;

(f) evaluating a CO emission rate of the emission products to calculate a ΔCO; and (g) adjusting the firebox temperature of the incinerator if ΔCO is greater than or less than 0.

One of the many advantages of the present invention is that less costly-fuel is now needed to maintain desirable destruction efficiency of waste. Accordingly, less energy is used in the incineration process; and therefore, the producer realizes a cost-savings. Another advantage of the present invention is that fewer undesirable emission products are generated because increases in air feed are avoided. Thus, the capital and operating costs associated with using a large amount of air in the system can be saved.

Other advantages of the present invention will be apparent to those of ordinary skill in the art in view of the following specification, claims and drawings.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The present invention provides, among other things, novel methods to optimize waste incineration processes such that compliance with environmental regulations is facilitated, and capital and operating costs are reduced.

Figure 1:
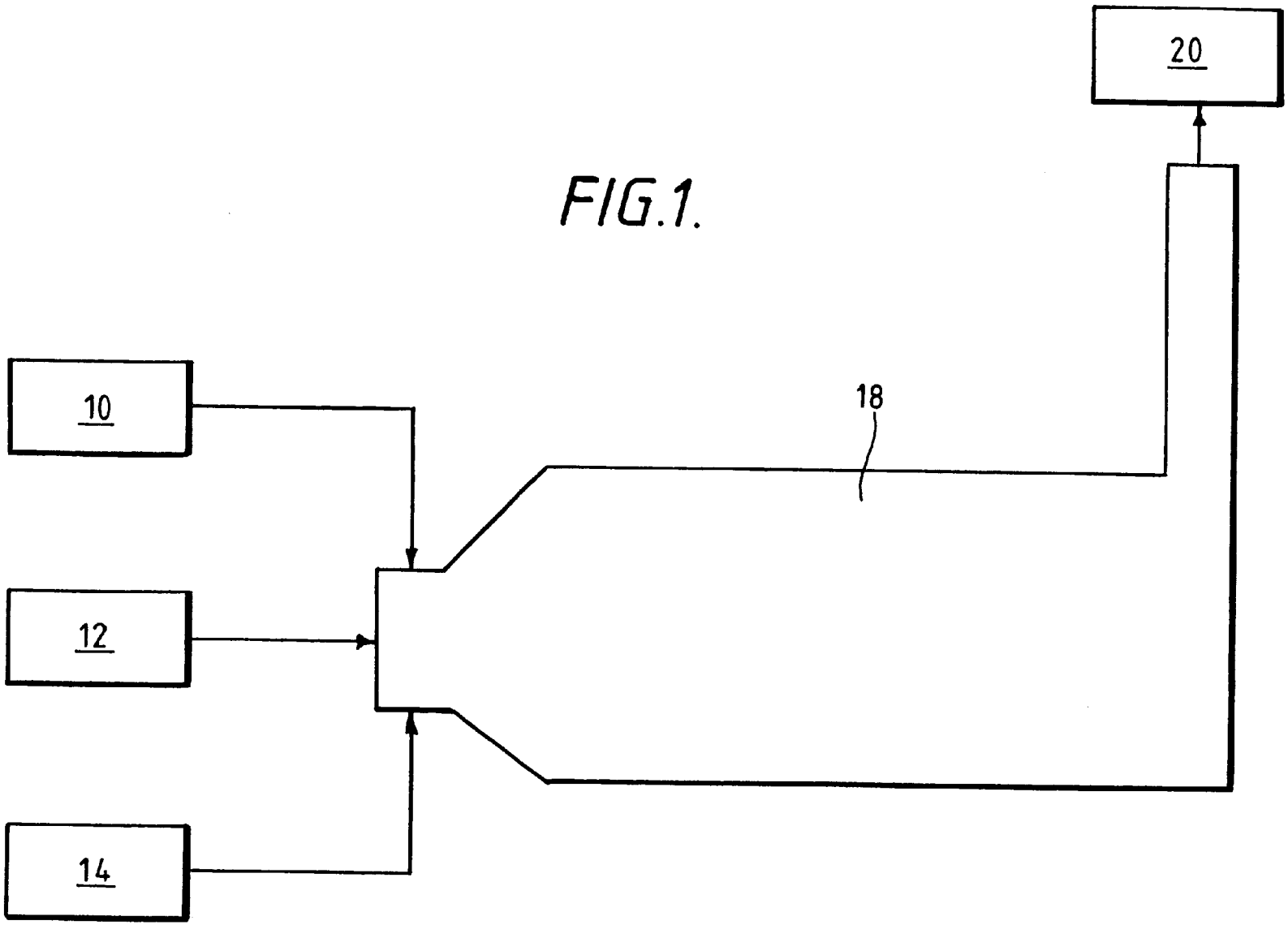
FIG. 1 is a depiction of a conventional thermal oxidizer, incinerator or combustor that may be used when practicing the present invention.

FIG. 1 is a depiction of one embodiment of a thermal oxidizer, furnace, incinerator, or combustor (collectively, "incinerator") encompassed by the present invention. In incinerator 18, the process begins with a waste stream being fed therein through source 10. The waste from source 10 may be a liquid, vapor, slurry, sludge, or a mixture thereof. This waste stream may contain organic and inorganic components, as well as oxygen. It is important to note that the waste stream generally has a fuel value of its own.

A fuel stream is fed into incinerator 18 from source 12. This fuel stream typically includes at least one of the following fuel sources: natural gas, oil, or a suitable waste stream having suitable fuel values.

An oxygen-containing stream is also fed into incinerator 18 from source 14. This oxygen-containing stream typically includes at least one of the following oxygen sources: pure oxygen, air (which is approximately 21% oxygen), or some other gas mixture comprising oxygen.

The contents of sources 10, 12 and/or 14 may be preheated prior to their introduction into incinerator 18, if desired.

Prior to and during the incineration process, the incinerator temperature is measured and monitored. The incinerator temperature, which is the incineration or operating temperature, is initially set at a known level.

Emission products resulting from the process are withdrawn from the incinerator through stream 20. In a particular incineration process at a chemical manufacturing facility, stream 20 may include $N_2$, $O_2$, $NO_x$, $CO_2$, CO, VOCs, and $H_2O$. As stated earlier, of principal concern because of environmental regulations are $NO_x$ and CO. $CO_2$ is a concern as well because it is a greenhouse gas.

Traditionally, the operating conditions for the incineration process are not been adjusted relative to changes in the waste stream or the emissions. Thus, more fuel and air than necessary are used. As a result, the incineration process is costly.

In the present invention, this process can be made cost effective by following the Feedback and Combined Feed Forward/Feedback Methods of temperature control provided herein. With these methods, it is now possible to correlate the minimum temperature required at a given waste load to achieve compliance with environmental regulations through minimal energy use.

Figure 2:
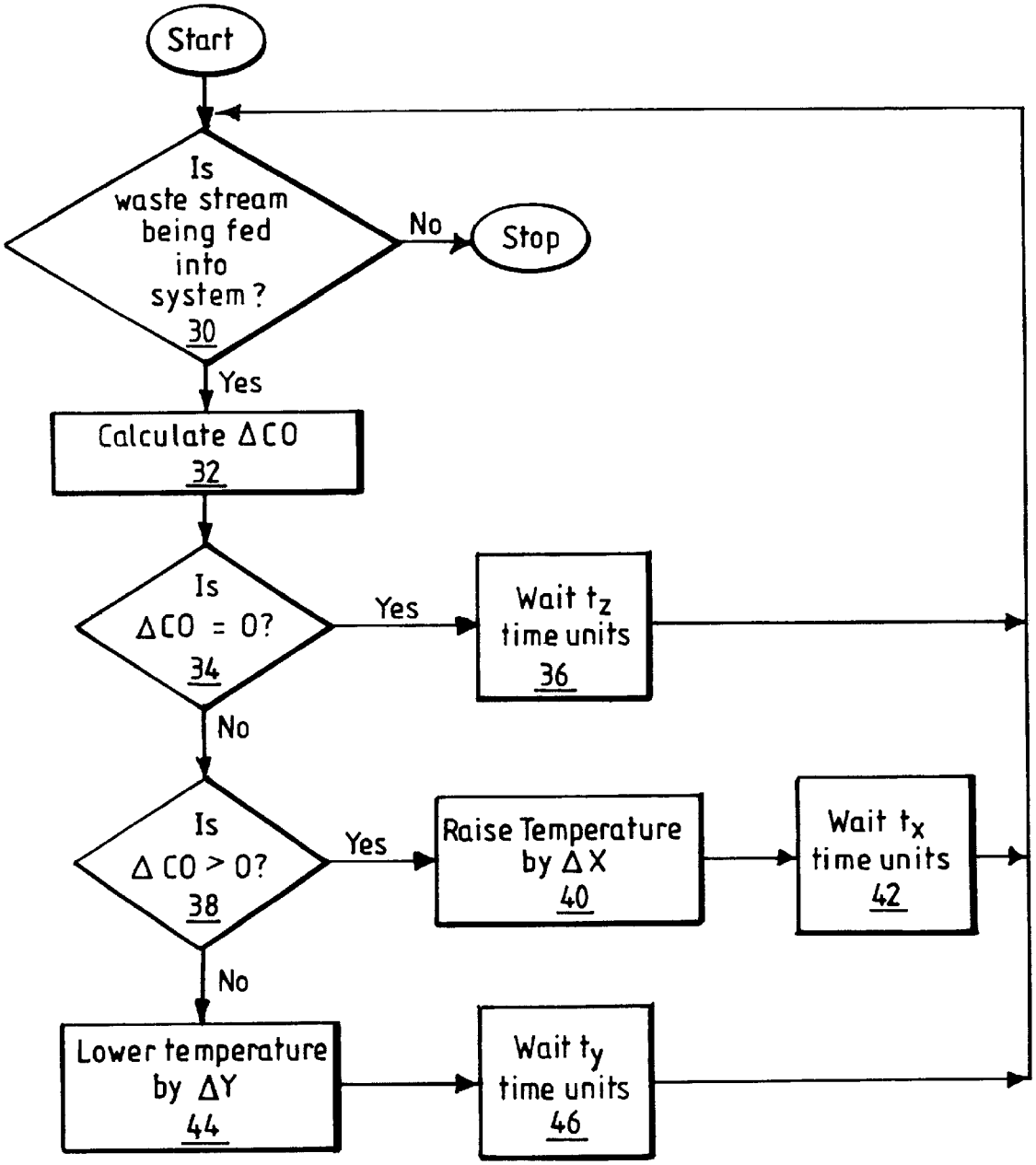
FIG. 2 is a flow chart describing the Feedback Method of temperature control for achieving CO compliance in accordance with one embodiment of practicing the present invention.

FIG. 2 is a flow chart describing the Feedback Method for optimization of an incineration process of the present invention. The first step 30 of the Feedback Method of the present invention is to determine whether a waste stream is being fed to the incinerator. If not, then the method ends there. However, if yes, then the second step 32 is to calculate the difference in the CO emissions rate or "ΔCO". ΔCO is equal to the CO rate of emissions at 20 (FIG. 1) minus the target rate, wherein the target rate could be equal to the CO permit rate plus or minus a CO confidence rate based on measurement variability, historical performance, and other criteria.

The confidence rate is essentially a safeguard or a margin of error. For example, if the CO permit rate is 550 lbs/hr CO emissions, and a 10% margin of error is deemed appropriate for the given process, the CO confidence rate would be 50 lbs/hr (22.7 Kg/hr.), with the resulting target rate being equal to 500 lbs/hr (227 Kg/hr) CO emissions. To determine the CO emissions rate, CO analyzers are preferable in the method of the present invention, however, $O_2$ analyzers, possibly in combination with visual observations, are also suitable indirect indicators of CO. Another suitable indicator could be an on-line process analyzer such as a Gas Chromatograph, a Mass Spectrometer, or a Gas Chromatograph/Mass Spectrometer combination.

It is envisioned that, in certain instances, sufficient operating data may be available such that a predictive measurement may be used as an alternative to direct measurement of CO or $O_2$ emissions. In essence, this amounts to a virtual Feedback Method and is functionally equivalent to one of the embodiments of the present invention. The feasibility of such an approach is improved for waste streams of relatively constant composition, flow rate and energy content, and is further enhanced when a large confidence factor is employed in the selection of the CO target value.

The next step 34 is to evaluate the actual CO emission rate determined in step 32 compared with the target level of CO emissions. If the ΔCO is at the desired level (or "O" in FIG. 2), then the next step 36 is to wait a designated time interval, $t_z$, and then repeat steps 30 and 32 by again checking the CO emission rate and calculating ΔCO. (See, FIG. 2 at 34, 36, 30 and 32).

If the CO emission rate is not equal to the target rate, then the next step 38 is to determine whether the CO emission rate is greater than or less than the target rate. If the CO emission rate is greater than the target rate, (ΔCO>0) then the next step 40 is to raise the firebox temperature at point 18 by ΔX. ΔX is a function of ΔCO: $[(\Delta X=f_2(\Delta CO)]$.

After the firebox temperature is raised by ΔX, then the next step 42 is to wait a designated time interval, $t_x$ time units, and then repeat step 32 by again checking CO emissions and calculating ΔCO at 32, wherein $t_x$ is a function of ΔX, or in other words, it is dependent on the adjustment made to temperature: $[(t_x=f_3(\Delta X)]$. If the CO emission rate is still greater than the target level, the firebox temperature is raised again by ΔX and time, $t_x$, is allowed to pass. It will be apparent to one of ordinary skill in the art that, as ΔX is a function of ΔCO, it may not be the same value or quantity on successive iterations of the method; similarly $t_x$, which is a function of ΔX, may be different on successive iterations.

If the CO emission rate is lower than the target level, (ΔCO<0) then too much energy is being consumed in the process. In that case, the next step 44 is to lower the firebox temperature by ΔY. ΔY is a function of ΔCO $[\Delta Y=f_1(\Delta CO)]$. The next step 46 is to wait a designated time interval, $t_y$, and then repeat step 32 by again checking CO emissions, wherein $t_y$ is a function of ΔCO: $[t_y=f_4(\Delta y)]$. ΔX and ΔY may or may not be equal; $t_x$ and $t_y$ may or may not be equal as well. Similarly, the functions defining ΔX, ΔY, $t_x$, and $t_y$ may or may not have the same mathematical form.

Selection of suitable functions, will be apparent to one of ordinary skill using the benefits obtained by the method of the present invention. The Feedback Method of temperature control for achieving CO compliance is a continuous process until the waste stream is spent.

Within the Feedback Method illustrated in FIG. 2, it is contemplated that it may be beneficial to include checks or limits on the firebox temperature such that a minimum firebox temperature is always maintained. In some preferred embodiments, such a minimum temperature setpoint will range between 800° F. (420 ° C.) to 1200° F. (649 ° C.). Also, it may be beneficial to limit the maximum firebox temperature setpoint, for example, to prevent mechanical and/or thermal damage to the incinerator and associated equipment. Selection and implementation of temperature setpoint limits are envisioned as within the scope of the present invention and within the ability of one of ordinary skill in the art after reading this specification.

Figure 3:
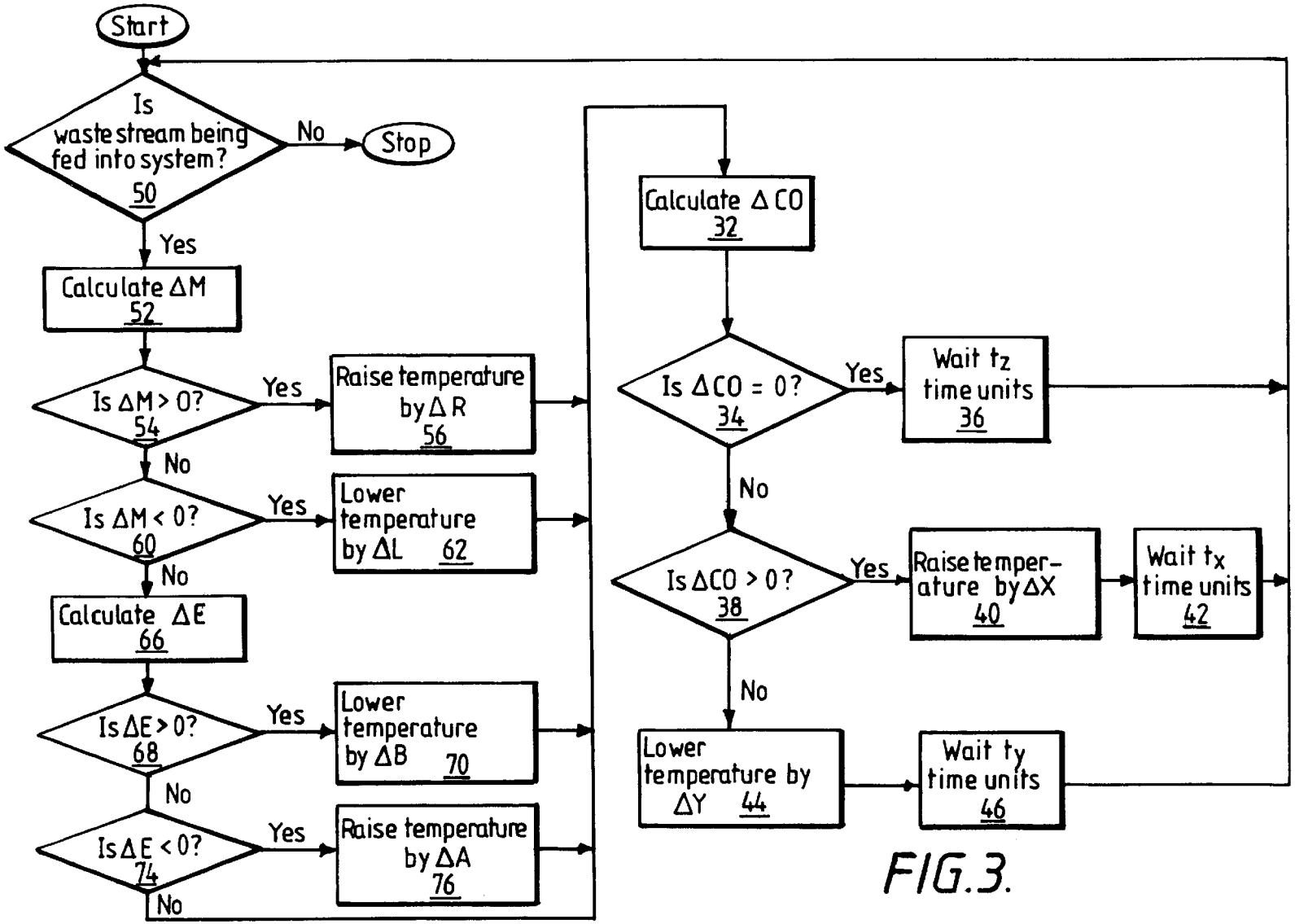
FIG. 3 is a flow chart describing the Combined Feed Forward/Feedback Method of temperature control for achieving CO compliance in accordance with one embodiment of practicing the present invention.

The Combined Feed Forward/Feedback Method for optimizing an incineration process of the present invention is described in the flow chart in FIG. 3. The Combined Feed Forward/Feedback Method allows one to look at the waste stream to control the initial temperature set-point before proceeding with the Feedback Method of firebox temperature control for achieving CO compliance of the present invention. In another embodiment of the present invention, the Combined Feed Forward/Feedback Method can also be used simultaneously with the Feedback Method to make a combined adjustment to the firebox temperature setpoint.

The feed rate and the fuel value of the waste stream as referred to herein are understood to mean for the combination of all waste streams that are fed into the system, as waste streams may be combined prior to incineration. In the first step 50 of the Combined Feed Forward/Feedback Method, it is determined whether or not a waste stream is being fed into the system. If so, then the second step 52 is to calculate ΔM, which corresponds to a change in the feed rate of the waste stream. ΔM is equal to the mass flow rate ("MFR") of the waste stream at time $t_1$, minus the MFR of the waste stream at time $t_0$ $[\Delta M=MFRt_1-MFRt_0]$, where $t_1>t_0$. If MFR has increased (ΔM >0), then the firebox temperature is raised by ΔR at 56. ΔR is a function of ΔM $[\Delta R=f_5(\Delta M)]$.

After the firebox temperature is raised by ΔR, the control method follows the Feedback Method beginning at step 32 by checking ΔCO and making the corresponding changes in temperature, namely, ΔX or ΔY, until the CO emission rate is at the target rate. After the CO emission rate is at target rate, the control method begins again with the Combined Feed Forward/Feedback Method at 50.

If the feed rate of the waste stream, MFR, has not increased ($\Delta M<0$, see FIG. 3 at 54), then the control method looks to see if the feed rate of the waste stream has decreased at step 60. If MFR has decreased, then the firebox temperature at point 18 (FIG. 1) is lowered by $\Delta L$ at 62. $\Delta L$ is also a function of $\Delta M$ [$\Delta L=f_6(\Delta M)$]. After dropping the temperature by $\Delta L$, the control method then turns to the Feedback Method at 32 as described above and continues to adjust the firebox temperature (FIG. 1) according to the CO emission rate. Once the CO emission rate is at the target rate, then the control method again turns to the Combined Feed Forward/Feedback Method and looks at the waste stream variables. If MFR of the waste stream has not increased or decreased (at 54 and 60), then the control method looks at the energy content, E, of the waste stream at steps 66, 68 and 74.

The energy content or E of the waste stream may vary due to a composition change that increases or decreases the fuel value of the waste stream. For example, in a waste stream comprising organics and air, a decrease in the air content (with a resultant increase in the organic content) will increase the fuel value of the stream, giving it a higher energy content. A preferred method for determining changes in the fuel value of the waste stream is to monitor the waste stream composition through direct analysis of the waste stream via an on-line process analyzer, such as a Gas Chromatograph, Mass Spectrometer, or Gas Chromatograph/Mass Spectrometer.

In an especially preferred embodiment, wherein the waste stream comprises oxygen, the oxygen content of the waste stream is monitored as well as the fuel value. In this embodiment, the air feed rate to the incinerator may then be reduced by an amount equal to the mass flow rate of oxygen provided by the waste stream, while still maintaining the desired air-to-fuel ratio. In this way, an undesirably high excess of oxygen—and the resultant increased fuel consumption and $NO_x$ generation that accompany it—may be avoided. Typically, the benefits of such an embodiment are maximized during non-steady state operating conditions, such as may occur during start-up, shutdown, or upset of the process(es) which generate the waste stream(s) fed to the incineration process.

It is envisioned that in some instances, it may be possible for the waste stream to comprise oxygen only under non-steady state conditions and to otherwise be substantially oxygen-free under steady-state operating conditions. Process composition analyzers, such as those described above, and/or commercially-available oxygen analyzers are suitable for implementing the method of this preferred embodiment. Use of this approach may be beneficially utilized with any of the methods (namely, the Feedback Method or the Combined Feed Forward/Feedback Method). Alternatively, monitoring changes in the operating conditions under which the waste stream was generated, when combined with process knowledge and/or prior measurements, may be sufficient to estimate changes in the fuel value of the stream. For example, increasing the ratio of hydrocarbon to $NH_3$ in an acrylonitrile reactor feed may lead to higher unreacted hydrocarbon content in the acrylonitrile process' AOG (absorber off gas) waste stream, which increases the fuel value of the waste stream.

The waste stream energy content may also change due to a change in the waste stream's absolute temperature. For example, if the temperature of the stream increases by 100° F. (38° C.), the energy content of the stream increases. A preferred method for determining changes in the temperature of the waste stream is to directly monitor it with one or more thermocouples.

Energy content may also change due to a change in the waste stream's physical state. For example, if the stream comprises liquid water at its boiling point and the stream is passed through a hot heat exchanger, the energy content of the stream will increase and at least a portion of the water in the waste stream will become water vapor. Changes in the state (e.g., liquid to gas) of the waste stream may be monitored through a combination of composition analysis, pressure/temperature measurement, and the use process knowledge.

In the Combined Feed Forward/Feedback Method, if the energy content, E, has increased ($\Delta E>0$), then the firebox temperature (FIG. 1) is lowered by $\Delta B$. $\Delta B$ is a function of $\Delta E$ [$\Delta B=f_7(\Delta E)$]. Once the firebox temperature is lowered by $\Delta B$, the control method turns to the Feedback Method again and analyzes the CO emission rate or $\Delta CO$ at 32. Once the CO emissions are at the target rate, the control method then turns to the Combined Feed Forward/Feedback Method and analyzes the waste stream variables.

If MFR has not increased or decreased, and E has not increased, then the control method looks to see if E has decreased at 74. If E has decreased ($\Delta E<0$), then the firebox temperature at point 18 is raised by $\Delta A$. $\Delta A$ is a function of $\Delta E$ [$\Delta A=f_8(\Delta E)$]. Once the $\Delta A$ adjustment has been made, the control method continues with the Feedback Method at 32 and analyzes the CO emission rate to adjust the firebox temperature at point 18 accordingly.

The Combined Feed Forward/Feedback Method of temperature control for achieving CO compliance is a continuous process until the waste stream is spent. Although described in the order shown in FIG. 3, it will be apparent to one of ordinary skill in the art after reading this specification that the Combined Feed Forward/Feedback Method is not significantly changed if the evaluation of $\Delta E$ is performed first, prior to the evaluation of $\Delta M$.

In certain embodiments of the present invention, the Combined Feed Forward/Feedback method may be simplified to the extent that it operates as a pure Feed Forward method. One of ordinary skill in the art will recognize, however, that this simplification is equivalent to the Combined Feed Forward/Feedback Method wherein the feedback measurement is obtained through a predictive, rather than direct (i.e., process analyzer) means. An example of the feed forward embodiment of the present invention is given below.

By way of example and not limitation, an example is given. In a carboxylic acid manufacturing process, unpurified product gas comprising carboxylic acid, hydrocarbons, and nitrogen are fed to an absorption tower. The absorption tower utilizes water to absorb the carboxylic acid from the product gas to generate a dilute aqueous carboxylic acid product stream and a gaseous waste stream, substantially free of carboxylic acid. The gaseous waste stream, comprising hydrocarbons and nitrogen, is fed to an incinerator for disposal.

The incinerator uses air as the oxygen feed source and natural gas as the fuel feed source; the absolute feed rates of air and natural gas, as well as the ratio of air to natural gas, are controlled by conventional automatic controllers manipulating control valves on each feed line. The mass flow rate of the gaseous waste stream varies proportionally with changes in the carboxylic acid manufacturing process production rate. Additionally, slight changes in the composition of the gaseous waste stream occur as a result of the variation of absorber efficiency with respect to the operating rate.

Figure 4:
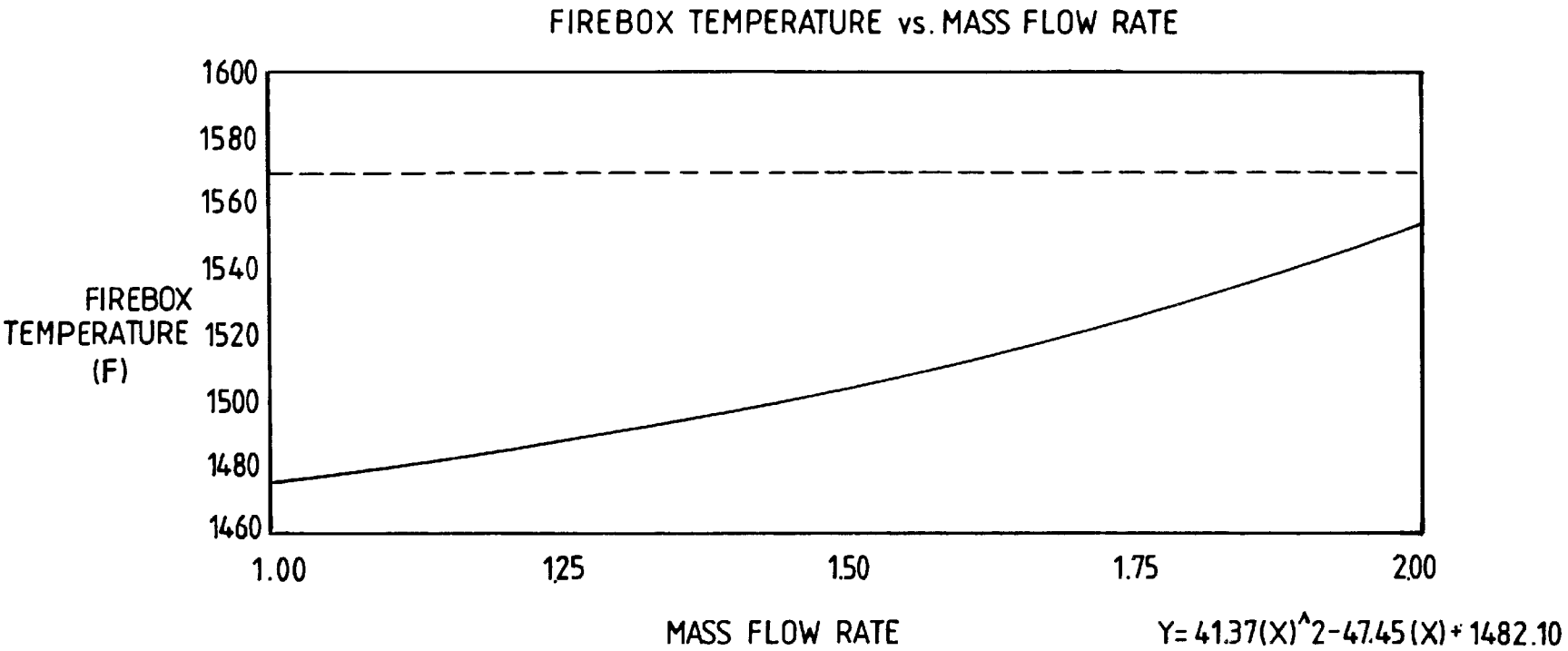
FIG. 4 is a graph of the correlation between temperature and waste mass flow rate, illustrating one of the improvements obtained in accordance with one embodiment of practicing the present invention.

The horizontal line in the FIG. 4 denotes the firebox temperature setpoint that is utilized in the prior art method of operation. It can be seen from the graph, that the setpoint of 1570° F. is not varied with changes in the mass flow rate of gaseous waste stream fed to the incinerator.

Figure 5:
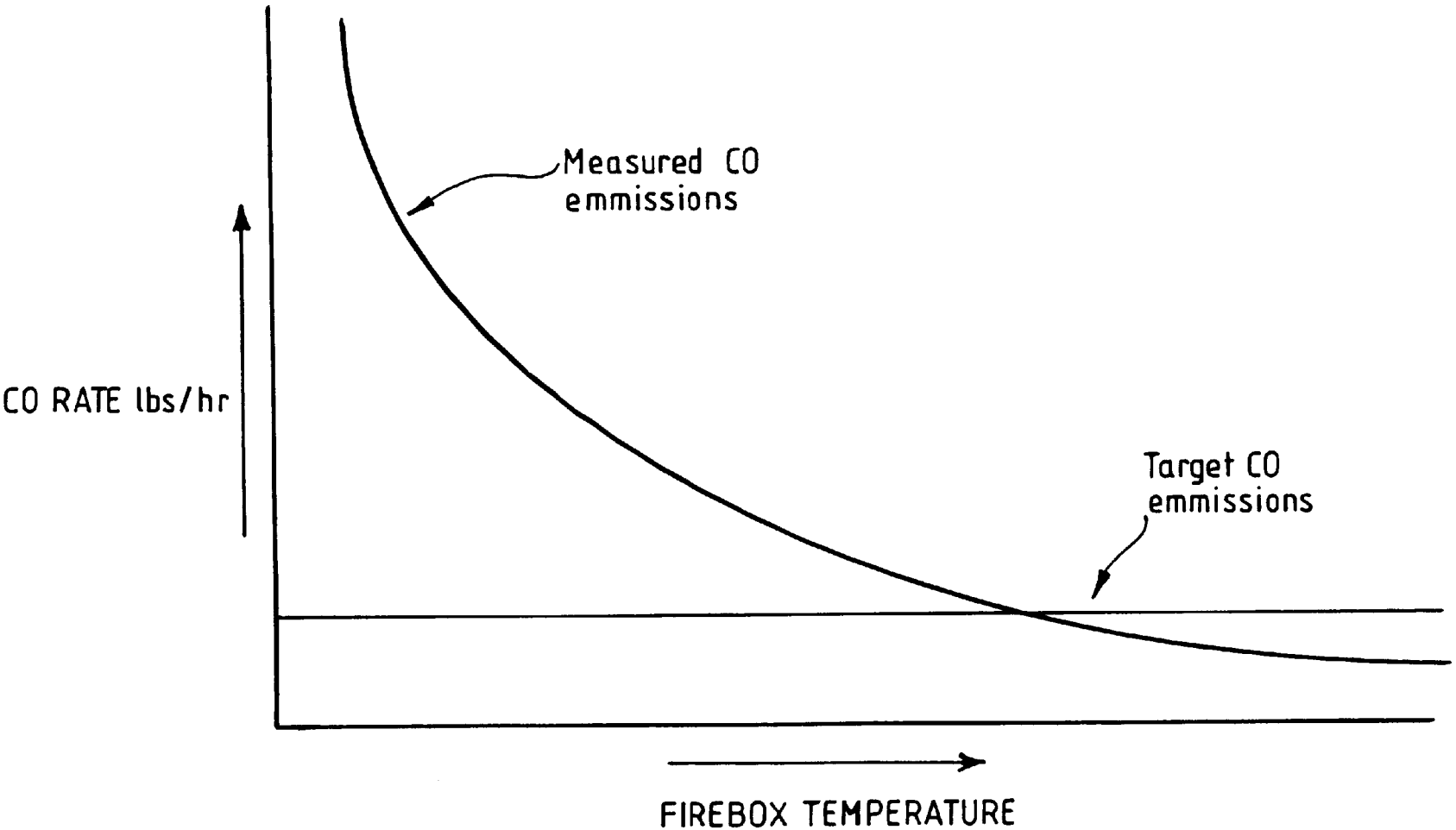
FIG. 5 is a graph of the correlation between CO concentration versus temperature at a given set of operating conditions in the incinerator.

The curve in the graph denotes the firebox temperature setpoint that is utilized in the methods of the present invention. This curve was developed in the following manner:

1. Based on safety and operability considerations, and utilizing means known in the prior art, the lowest excess oxygen level for operation was determined. This ratio of oxygen feed to fuel feed was maintained constant throughout the testing.
2. The minimum and maximum gaseous waste mass flow rates were then determined.
3. A plurality of mass flow rates within the range were identified as test measurement conditions.
4. For each test measurement condition, the incinerator effluent composition was monitored and the firebox temperature was gradually reduced, until the minimum temperature at which the targeted CO emissions rate could be met had been identified. An example of data describing this step is shown in FIG. 5.
5. Mathematical methods known to those of ordinary skill were then used to determine a polynomial expression which closely matched the specific firebox temperature vs. mass flow rate data collected. Through use of this polynomial expression, wherein x denotes the mass flow rate of gaseous waste and y denotes the corresponding firebox temperature setpoint, the specific firebox temperature setpoint value necessary at any given mass flow rate as needed to minimize fuel consumption while remaining in compliance with CO emissions requirements was then determined. The specific polynomial derived in this example was:

$$y=41.37x^2-57.45x+1482.10$$

It can be seen from the graph that the firebox temperature setpoint varies from approximately 1475° F. at low gaseous waste stream mass flow rates to approximately 1540° F. at high gaseous waste stream mass flow rates. These temperatures are much lower than the setpoint utilized in the prior art method (i.e., 1570° F.) and represent a significantly lower operating cost for the incineration process due to the reduction in fuel consumption provided by the lower operating temperature of the incinerator.

Because a polynomial expression maybe derived from actual stack test measurements of CO content in the effluent of the incinerator, it is no longer necessary to directly measure the CO content of the incinerator effluent (feedback via direct means). In one preferred embodiment of the method of the present invention, this polynomial is incorporated into an automatic control system algorithm to automatically monitor mass flow rate of the gaseous waste and adjust the firebox temperature setpoint in accordance with the method of the present invention.

Other optional additions to the incineration process of the present invention include but are not limited to preheating of the waste stream, fuel, and/or air feeds to the incinerator, scrubbers in the stack of the incinerator, particulate filters in the stack of the incinerator, catalytic reduction units (including selective and non-selective units) in the stack of the incinerator, or electrostatic precipitators in the stack of the incinerator. These enhance the reduction in emissions realized as a result of the methods of the present invention.

Also contemplated within the present invention is the use of a boiler in conjunction with the incinerator wherein the stream produced by the boiler is recovered and used in other processes like an electricity generation process or for heating in other process operations. A waste to energy system such as this increases the overall cost savings realized by the present invention.

The ultimate result of the present invention is that emissions are at the target level and the process is cost-effective. Heretofore, known systems have not met both of these criteria. Furthermore, the methods of the present invention allow the incineration process to adapt to changes in the waste stream so that energy consumption by the process is optimized and emissions remain at the target level.

Although the present invention has been described in detail, it should be understood that various changes, substitutions and alterations can be made hereto without departing from the spirit and scope of the invention as defined by the appended claims.

What is claimed is:

1. A method of incinerating industrial waste producing emission products comprising the steps of:

(a) determining whether a waste stream is being fed into the incinerator, (b) evaluating a CO emission rate of the emission products to calculate a ΔCO, which is equal to the CO emission rate minus a target CO emission rate;

if ΔCO is equal to zero, waiting a designated time interval $t_z$ and then repeating steps (a) and (b); or if ΔCO is greater than zero, increasing a firebox temperature of the incinerator by an increment ΔX, wherein ΔX is a function of ΔCO, waiting a designated time interval $t_x$ and then repeating steps (a) and (b); or if ΔCO is less than zero, decreasing the firebox temperature of the incinerator by an increment ΔY, wherein ΔY is a function of ΔCO, waiting a designated time interval $t_y$ and then repeating steps (a) and (b).

2. The method of incinerating industrial waste according to claim 1 wherein the target CO emission rate is less than 500 lbs/hr.

3. The method of incinerating industrial waste according to claim 1 wherein evaluating the CO emission rate is accomplished by using a CO analyzer, an $O_2$ analyzer, a Gas Chromatograph, A Mass Spectrometer, or a Gas Chromatograph/Mass Spectrometer combination.

4. A method of incinerating industrial waste producing emission products comprising the steps of:

(a) determining whether a waste stream having a feed rate and a fuel content is being fed into an incinerator;

() measuring the feed rate of the waste stream to determine a ΔM, ΔM being equal to the mass flow rate of the waste stream, at a time $t_1$, minus the mass flow rate of the waste stream, at a time $t_0$, where $t_1>t_0$;

if ΔM is greater than zero, increasing a firebox temperature of the incinerator by an increment ΔR, wherein ΔR is a function of ΔM, then go to step (d); or if ΔM is less than zero, decreasing the firebox temperature of the incinerator by an increment ΔL, wherein ΔL is a function of ΔM, then go to step (d); or if ΔM is equal to zero, go to step (c);

(c) analyzing the energy content of the waste stream to calculate a $\Delta E$, $\Delta E$ being equal to the energy content of the waste stream, at a time $t_1$, minus the energy content of the waste stream, at a time $t_0$, where $t_1 > t_0$;

if $\Delta E$ is greater than zero, decreasing the firebox temperate of the incinerator by an increment $\Delta B$, wherein $\Delta B$ is a function of $\Delta E$, then go to step (d); or if $\Delta E$ is less than zero, increasing the firebox temperature of the incinerator by an increment $\Delta A$, wherein $\Delta A$ is a function of $\Delta E$, then go to step (d); or if $\Delta E$ is equal to zero, go to step (d);

(d) evaluating a CO emission rate of the emission products to calculate a $\Delta CO$, which is equal to the CO emission rate minus a target CO emission rate;

if $\Delta CO$ is equal to zero, waiting a designated time interval $t_z$, and then repeating steps (a) and (b); or if $\Delta CO$ is greater than zero, increasing the firebox temperature of the incinerator by an increment $\Delta X$, wherein $\Delta X$ is a function of $\Delta CO$, waiting a designated time interval $t_x$ and then repeating steps (a) and (b); or if $\Delta CO$ is less than zero, decreasing the firebox temperature of the incinerator by an increment $\Delta Y$, wherein $\Delta Y$ is a function of $\Delta CO$, waiting a designated time interval $t_y$ and then repeating steps (a) and (b).

5. The method of incinerating industrial waste according to claim 4 wherein the target CO emission rate is less than 500 lbs/hr.

6. The method of incinerating industrial waste according to claim 4 wherein the waste stream is a liquid, vapor, slurry, sludge, or a mixture thereof.

7. The method of incinerating industrial waste according to claim 4 wherein evaluating the CO emission rate to calculate $\Delta CO$ is determined utilizing a CO analyzer, an $O_2$ analyzer, a Gas Chromatograph, A Mass Spectrometer, or a Gas Chromatograph/Mass Spectrometer combination.

8. The method of incinerating industrial waste according to claim 4 wherein the analyzing a fuel content of the waste stream to calculate $\Delta E$ is determined by an online analyzer.

9. The method of incinerating industrial waste according to claim 8 wherein the on-line analyzer is a Gas Chromatograph, a Mass Spectrometer, or a Gas Chromatograph/Mass Spectrometer combination.

10. The method of incinerating industrial waste according to claim 4 further comprising prior to step (a) analyzing a oxygen content of the waste stream prior to incineration.

* * * * *